US006290475B1

(12) United States Patent
Snow

(10) Patent No.: US 6,290,475 B1
(45) Date of Patent: Sep. 18, 2001

(54) HELICAL WIPER FOR SUCKER ROD PUMP

(76) Inventor: Jerry M. Snow, 2200 Lone Tree Ct., Bakersfield, CA (US) 93312

( * ) Notice: Subject to any disclaimer, the term of this patent is extended or adjusted under 35 U.S.C. 154(b) by 0 days.

(21) Appl. No.: 09/537,483

(22) Filed: Mar. 30, 2000

(51) Int. Cl.[7] ..... F04B 39/00
(52) U.S. Cl. ..... 417/430; 166/105.2
(58) Field of Search ..... 417/430, 53, 547, 417/445, 552, 401, 554; 166/105.2, 371

(56) References Cited

U.S. PATENT DOCUMENTS

| | | | | |
|---|---|---|---|---|
| 2,074,591 | | 3/1937 | Rood . | |
| 2,086,816 | | 7/1937 | Mullins . | |
| 2,635,554 | | 4/1953 | Haley . | |
| 4,013,387 | * | 3/1977 | Gage | 417/554 |
| 4,026,661 | * | 5/1977 | Roeder | 417/53 |
| 4,395,204 | * | 7/1983 | Turner | 417/554 |
| 4,490,097 | * | 12/1984 | Gilbertson | 417/401 |
| 4,661,052 | * | 4/1987 | Ruhle | 417/552 |
| 4,880,062 | * | 11/1989 | Bland | 166/371 |
| 5,141,411 | * | 8/1992 | Klaeger | 417/445 |
| 5,660,534 | | 8/1997 | Snow . | |
| 6,099,274 | * | 8/2000 | Conn | 417/547 |
| 6,145,590 | * | 11/2000 | Havard | 166/105.2 |
| 6,155,792 | * | 12/2000 | Hatley et al. | 417/53 |

* cited by examiner

*Primary Examiner*—Teresa Walberg
*Assistant Examiner*—Leonid Fastovsky
(74) *Attorney, Agent, or Firm*—Daniel C. McKown

(57) ABSTRACT

A device that can be attached to the plunger of a sucker rod pump to extend the operational life of the pump when it is used for producing oil having a high sand content wipes sand from the wall of the barrel in which the plunger reciprocates and re-routes the sand into the stream of oil that flows through the plunger on its downstroke. At the same time, the device applies a torque to the plunger causing it to rotate on the downstroke, thereby distributing wear more uniformly around the cylindrical outer surface of the plunger and the inside surface of the barrel. The device permits commercially available plungers to be used without modification for producing sand-laden oil.

2 Claims, 3 Drawing Sheets

HELICAL WIPER FOR SUCKER ROD PUMP

BACKGROUND OF THE INVENTION

1. Field of the Invention

The present invention is in the field of pumps for use in pumping oil from an oil well, and more specifically relates to apparatus for use in a sucker rod pump to adapt it for pumping oils containing sand.

2. The Prior Art

Particles of sand and rock have long been considered to be unwelcome intruders in the pumps used to produce oil. They cause abrasion and friction between the moving parts of the pump, and an accumulation of sand above or below the plunger can prevent motion of the plunger, thereby shutting down the well.

Inventors have long sought to deal with these problems by skillful management of the sand.

In a sucker rod pump, sand causes abrasion of the outer surface of the plunger and the inner surface of the pump barrel within which the plunger reciprocates. This causes wear which increases the clearance between the moving parts, thereby reducing the efficiency of the pump and weakening the parts.

To reduce sand-caused wear on the plunger and pump barrel, pump designers have provided wipers at one or both ends of the plunger. The wipers precede the plunger as it moves, wiping sand from the inner surface of the pump barrel. The wipers are toroidal and may be composed of a variety of materials. Typically, wipers are seated in a circumferential groove on a short cylindrical wiper body of metal. Wiping rings of this type are also called "horizontal wipers" because they are disposed in a plane perpendicular to the axis of the pump barrel, which would be vertical for a vertical well.

Horizontal wiper rings bring with them some unique problems. Sand soon becomes trapped between the upper and lower horizontal wiper rings, thereby increasing the wear inflicted on the plunger and barrel, compared with the wear produced in the absence of the wipers when the circulation of oil between the plunger and barrel tends to carry away the sand rather than to trap it. Further, if too much sand becomes compacted below the lower horizontal ring and above the standing valve, it can stack up the rod string by preventing downward motion of the plunger.

Although horizontal wiping rings are used to this day, other more sophisticated approaches based on the concept of circulating the sand rather than isolating it, have been proposed.

In U.S. Pat. No. 2,635,554 issued Apr. 21, 1953 to Haley, there is described a generally cylindrical shaped plunger having a network of grooves formed in its outer surface. Some of the grooves are disposed in planes perpendicular to and spaced along the axis of the plunger. These horizontal grooves are connected by staggered axially-extending grooves. Radially-extending passages connect the horizontal grooves to the hollow interior of the plunger. In theory, sand precipitating onto the upper end of the plunger will be channeled through the grooves into the bore of the plunger and be produced. There is no provision for wiping the inner surface of the barrel, and sand might collect and pack in the rather small grooves. Ultimately, the excellence of Haley's concept of producing the sand is defeated by the practical difficulty of machining in steel the intricate network of grooves and passages necessary to implement it. As will be seen below, the present invention avoids this practical difficulty and in addition produces a torque that rotates the plunger to distribute the wear more evenly.

In U.S. Pat. No. 2,086,816 issued Jul. 13, 1937 to Mullins there is shown a plunger that has at its upper end a helical ring seated in a helical groove and extending into the clearance space between the plunger and the barrel to serve as a wiper. This device would not be effective in a modern pumping system because the small amount of contact or seal area provided by the helical ring would result in excessive pump slip. Also, the reduced contact area would result in excessive wear of the ring which would reduce its operational life.

In U.S. Pat. No. 2,074,591 issued Mar. 23, 1937 to Rood, there is shown a plunger having helical grooves winding around its external surface. These helical grooves necessarily contain no sealing or wiping rings, but instead are only passages for oil to flow through. A radial passage connects the lower end of each helical groove to a small axial passage inside the plunger that is connected by a miniature check valve to the bore of the plunger. The sand is carried along with some oil through the grooves, passages and check valves to the bore of the plunger and is ultimately produced. In practice it would be extremely expensive to machine the various grooves and passages in a plunger and to install the miniature check valves. Further, the dimensions of these parts must be rather small, and therefore they are susceptible to plugging. Once that has occurred, sand would accumulate in the grooves and accelerate wear.

In U.S. Pat. No. 5,660,534 issued Aug. 26, 1997 to Snow, there is shown the use of helical grooves, located either in the cage or in an attached upper plunger for the purpose of imparting a rotational movement to the plunger about its axis so as to distribute the wear more evenly. The disclosure of this patent is hereby incorporated by reference for the purpose of providing a fuller explanation of the background of the present invention.

Notwithstanding the ingenuity apparent in these earlier patents, a practical and effective solution to the problems associated with sand has not been achieved.

SUMMARY OF THE INVENTION

One object of the present invention is to reduce the tendency of sand to accumulate between the wiper rings.

Another object ofthe present invention is to produce a rotation ofthe plunger to distribute wear more evenly, thereby improving the operational life of the pump.

A third object of the present invention is to facilitate the production of sand, along with the oil. The sand is much more easily separated from the oil above ground.

In accordance with the present invention a separable wiper body is attached to the plunger of a sucker rod pump for the purpose of wiping sand from the interior surface of the pump barrel. The wiper body is a hollow cylinder having a helical groove formed in its outwardly facing surface and winding several turns around the cylinder. The wiper body further includes at least one passage located between successive turns of the helical groove and extending radially through the hollow cylinder of the wiper body. This configuration encourages sand to flow into the bore of the plunger, from which it is subsequently produced, and also imparts a rotational motion to the plunger for the purpose of distributing wear more evenly.

DETAILED DESCRIPTION OF THE PREFERRED EMBODIMENT

Figure 1:
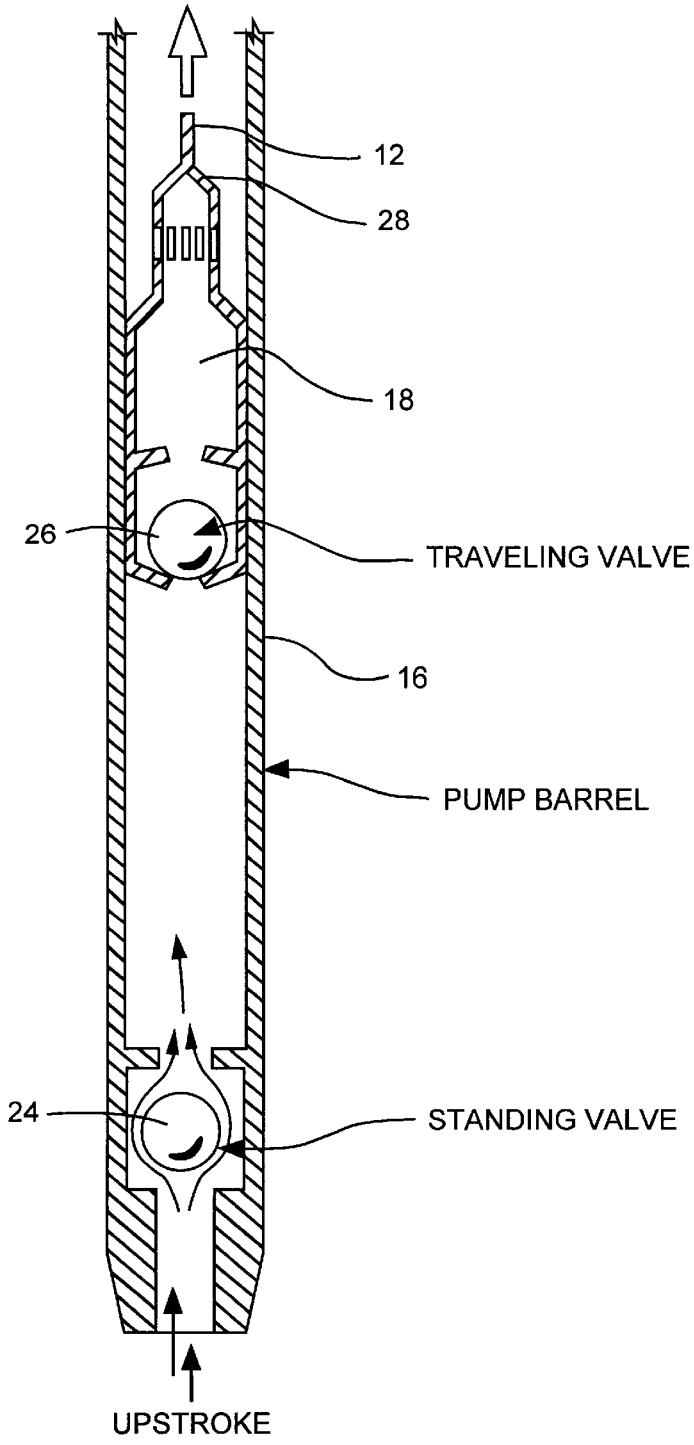
FIG. 1 (PRIOR ART)
FIG. 1 is a diagram showing a typical sucker rod pump of the prior art during an upstroke phase of its cycle of operation.
Figure 2:
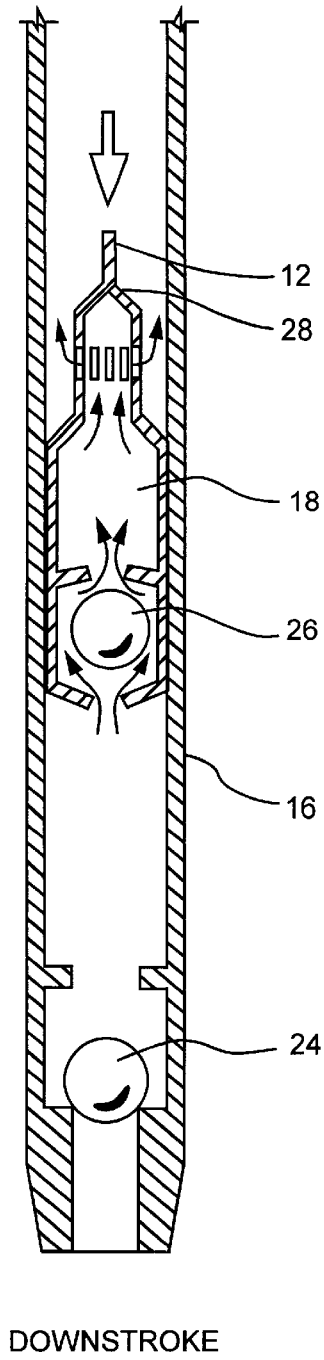
FIG.2 (PRIOR ART)
FIG. 2 is a diagram showing a typical sucker rod pump of the prior art during a downstroke phase of its cycle of operation.

FIGS. 1 and 2 show a type of prior art pump to which the present invention may be applied. A plunger 18 is moved up and down by a rod string 12 within the pump barrel 16. A standing valve 24 is located at the lower end of the pump barrel, and oil enters the pump barrel through it. The standing valve 24 allows oil to flow upward into the space within the pump barrel, but prevents the oil from flowing downwardly out of the pump barrel. The plunger 18 includes a traveling valve 26. The plunger 18 is hollow or includes a bore to permit the oil to flow upward. The traveling valve 26 permits the oil to flow upwardly through the plunger 18 during the downstroke, but prevents the oil from flowing downwardly out of the plunger during the upstroke. The upper end of the plunger includes a number of apertures that permit the oil to flow upwardly out of the plunger. This part of the plunger is usually referred to as the cage 28.

During the upstroke, as shown in FIG. 1, the standing valve is open permitting oil to be drawn into the pump barrel. The oil above the traveling valve 26 is lifted and carried upwardly within an upward extension of the barrel 16 to the ground level.

FIG. 2 shows the downstroke phase of the cycle of operation. During this phase, the standing valve 24 is closed, and the plunger 18 is forced downward, so that the oil within the pump barrel is forced to flow upwardly through the traveling valve 26 and through the bore of the plunger 18, thereby positioning the oil above the plunger so that it will be lifted on the following upstroke.

In prior art pumps of the type shown in FIGS. 1 and 2, the plunger 18 fits within the pump barrel in a loose sliding fit. Particles of sand and rock included in the oil found their way into the small space between the plunger and the barrel and caused undesirable consequences. Abrasive materials that had become lodged unevenly between the plunger and the barrel caused severe localized wear to both the plunger and the barrel. Oil sand could even cause the plunger to become stuck within the barrel. Galling, caused by wear and heat was common on both the plunger and the barrel.

One highly successful approach to reducing these problems was described in U.S. Pat. No. 5,660,534 issued Aug. 26, 1997 to Snow for "Rotating Plunger for Sucker Rod Pump". In that approach, the oil was forced to flow through helical passages located on the cage or on a separate piece attached to the cage to generate a torque for rotating the plunger within the barrel. This rotation of the plunger distributed the wear uniformly around the circumference of the plunger thereby greatly increasing its operational life. This approach proved to be highly successful. It was tested in approximately 600 wells and it reduced pull frequency by 51 percent and pump repair costs by 37 percent. These tests were described in a technical paper titled "Improved Pump Run Time Using Snow Auto-Rotating Plunger (SARP) Pump", Paper No. SPE 46217, presented at the 1998 Society of Petroleum Engineers Western Regional Meeting held in Bakersfield, Cali., May 10–13, 1998. The present invention carries this approach forward another step.

In this new approach, the rotational motion of the plunger is produced by the flow of oil through helical wipers that are attached to the lower and/or upper ends of the plunger, as will be described below.

Figure 3:
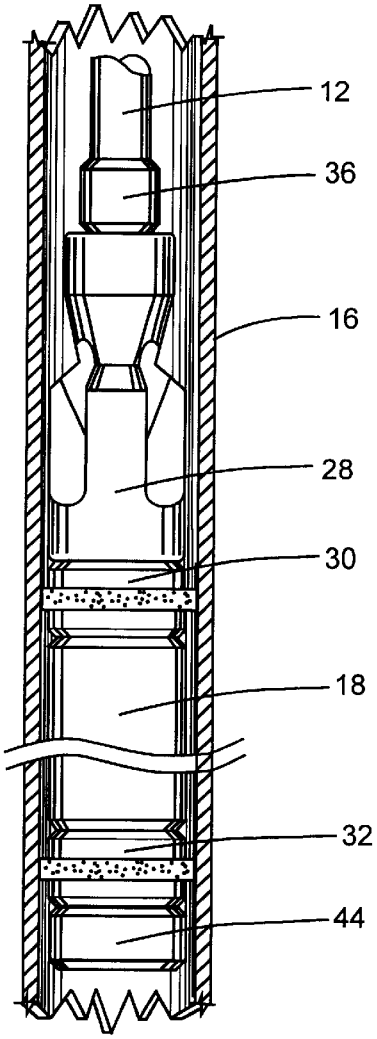
FIG.3 (PRIOR ART)
FIG. 3 is a fractional diagram showing portions of the prior art pump of FIGS. 1 and 2 in greater detail.

The idea of using a wiper attached to the plunger to move ahead of the plunger and to wipe sand from the surface of the barrel is not new in the art. FIG. 3 shows a typical prior art pump in which horizontal wiper rings are used. The word "horizontal" is commonly used in the art to indicate that the wiper ring is disposed in a plane that is perpendicular to the axis of the plunger.

As shown in FIG. 3, in the prior art, an upper wiper ring 30 is connected by threads to the upper end of the plunger 18 and the cage 28 is screwed into the upper wiper ring 30. Similarly, a lower wiper ring 32 is connected to the lower end of the plunger 18.

The structure of the upper wiper ring 30 is similar to the structure of the lower wiper ring 32. Both wiper rings have an outer cylindrical surface into which a circumferential groove has been machined. A ring of wiper material is seated in this groove and extends radially slightly beyond the outer cylindrical surface, permitting the material to contact the wall of the barrel, to wipe it.

Unfortunately, the use of horizontal wiper rings as shown in FIG. 3 has not produced noteworthy results when used in sand-laden oil. In practice, sand gets past the rings and becomes trapped between the upper and lower rings thereby causing wear on the areas the rings were intended to protect. Also, if too much sand becomes compacted below the lower horizontal ring it can cause the rod string to stack up on the downstroke. If sand builds up above the upper wiper ring, the rod string can stick on the upstroke.

Some attempts to go beyond the use of horizontal sealing rings have been described above in the discussion of the prior art. The known approaches appear to be impractical because they require extensive machining ofthe plunger. Contemporary plungers consist of sections of tubing composed of a very hard steel to resist abrasion and chemical attack. This steel is difficult and expensive to machine, making economically impractical those approaches that rely on the machining of intricate networks of grooves in the outer surface of the plunger. Typically the plunger is the second most expensive component of the pump, and therefore it should be protected from the sand rather than exposed directly to the sand.

Figure 4:
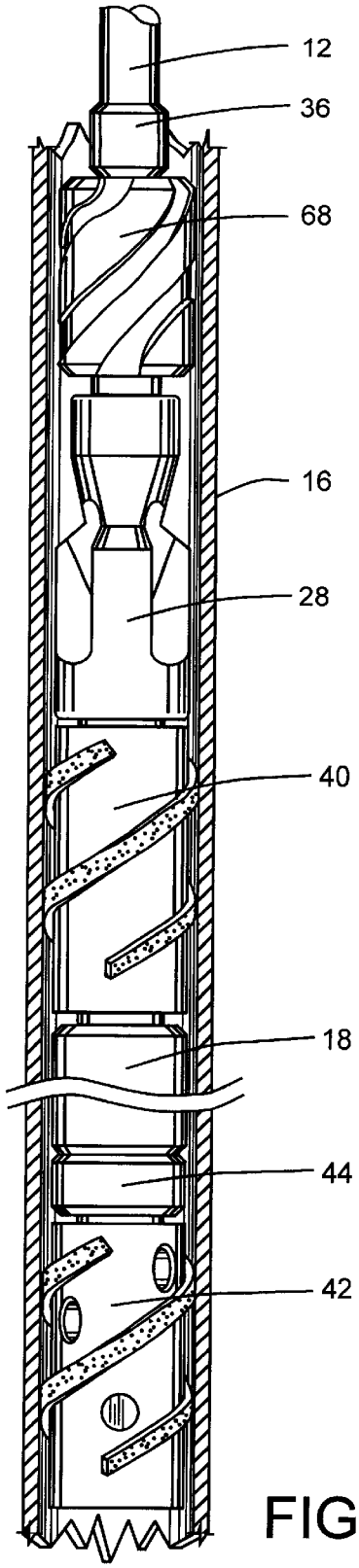
FIG. 4 is a diagram showing portions of a sucker rod pump in accordance with the present invention; and, FIG. 5 is a side elevational view with a quarter cut away, showing a preferred embodiment of the lower wiper body of the present invention.

In contrast, the present invention requires no machining of the plunger and instead permits the use of commercially available plungers. In accordance with the present invention, separate removable upper and lower wiper bodies are connected to the plunger at its ends. As shown in FIG. 4, an upper wiper body 40 is inserted between the upper end of the plunger 18 and the cage 28, and a lower wiper body 42 is attached to the lower end of the traveling valve 44, which, in turn is attached to the lower end of the plunger 18. This approach avoids the need to perform any machining on the hardened steel of the plunger. Both the upper wiper body and the lower wiper body are composed of steel, except for the sealing material.

Figure 5:
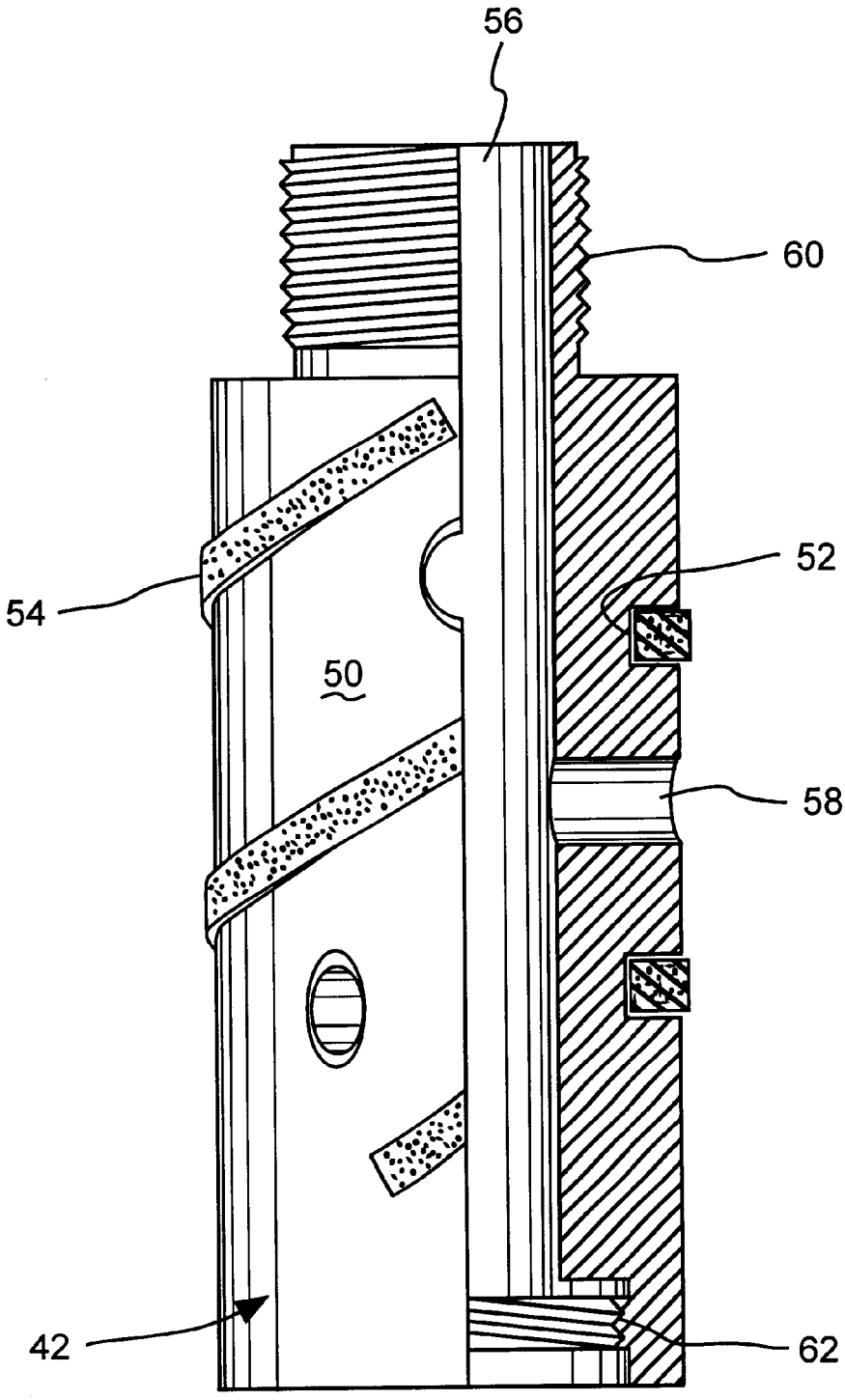

FIG. 5 is a side elevational view with one quarter cut away showing a lower wiper body in a preferred embodiment of the present invention. The lower wiper body has a cylindrical outer surface 50 into which a helical groove 52 extends. In the preferred embodiment, two separate and diametrically opposed helical grooves are provided. A length of sealing material 54 is seated in each helical groove, and the sealing material extends slightly beyond the cylindrical outer surface 50 in the radial direction. A central bore 56 extends axially completely through the wiper body to permit the oil to flow through it into the plunger. A number of radial passages, of which the passage 58 is typical, extend from the cylindrical outer surface 50 to the central bore 56. These passages permit sand to pass inwardly from the space between the barrel and the cylindrical outer surface 50 to the central bore 56. The radially-extending passages are disposed between the helical grooves. In the embodiment of FIG. 5, a male thread 60 extends from one end of the lower wiper body, and a female thread 62 is provided at the other end to permit the wiper body to be connected to other components of the plunger assembly. In alternative embodiments, the lower wiper body may be provided with two male threads or two female threads.

The structure of the upper wiper body 40 is identical to that of the lower wiper body except that in the upper wiper body 40 the radially-extending passages are omitted.

In the preferred embodiment, the sealing material is composed of a rubber and duck composition readily available commercially; any of a wide variety of sealing materials could be used as alternatives.

The helical wipers of the present invention avoid the difficulties inherent in horizontal wiper rings and, in addition, the helical wipers operate to greatly reduce the harmful effects of sand.

In operation on the upstroke, the upper wiper body keeps the sand out of the thin space between the plunger and the pump barrel. Because no oil is flowing through the plunger on the upstroke, neither the upper nor the lower wiper body imparts any rotational motion to the plunger on the upstroke.

In operation on the downstroke, the lower wiper body prevents sand from entering the space between the plunger and the pump barrel, and because oil is flowing upward through the plunger, both the upper and lower wiper bodies produce a torque that rotates the plunger about its axis. On the downstroke, oil is flowing rapidly upward through the central bore 56 of the lower wiper body creating a reduced pressure in the radially-extending passages 58. This reduced pressure draws into the central bore 56 oil and sand from the space between the turns of sealing material on the outside of the lower wiper body, thereby disposing of sand that might be there.

The radially-extending passages 58 are not needed on the upper wiper body 40 because on the downstroke whatever sand may be present is already above the plunger.

In an alternative embodiment, the radially-extending passages 58 are elongated in the axial direction so as to extend from one turn of sealing material to the next turn. As indicated in FIG. 4, a rotation-imparting plug 68 having helical grooves in its cylindrical outer surface can be used in association with the present invention to augment the torque applied to the plunger 18. The plug 68 is described more fully in U.S. Pat. No. 5,660,534.

Thus, there has been described a wiper system that acts to prevent sand from getting into the space between the plunger and the pump barrel and that acts to help rotate the plunger within the pump barrel to distribute wear more uniformly.

By reducing the damaging effects of sand, the present invention greatly extends the operational life of the pump thereby reducing production costs and making it economically feasible to produce oil from extremely sandy wells.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. In a sucker rod pump of a type having a plunger that reciprocates within a pump barrel in a sliding fit, an improvement for reducing harm to the pump caused by sand intermixed with the fluid being pumped, the improvement comprising:

a lower wiper body connected to a lower end of the plunger and including a hollow cylinder having an axial bore extending completely through it, having an outwardly facing surface, and having a helical groove in said outwardly facing surface;

wiper material seated in said helical groove and protruding radially outward beyond said outwardly facing surface of said hollow cylinder; and, a passage extending through said hollow cylinder from the axial bore to a location on said outwardly facing surface outside said helical groove;

whereby, on a downstroke of the plunger, the wiper material precedes the plunger to wipe sand from the pump barrel, and simultaneously, some of the fluid being pumped flows under pressure between said hollow cylinder and the pump barrel, carrying the wiped sand through said passage into the bore of said hollow cylinder and imparting a torque to said lower wiper body which causes the plunger to rotate so as to distribute wear on the plunger and the pump barrel more uniformly.

2. In a sucker rod pump of a type having a plunger that reciprocates within a pump barrel in a sliding fit, an improvement for reducing harm to the pump caused by sand intermixed with the fluid being pumped, the improvement comprising:

an upper wiper body connected to the upper end of the plunger and including a hollow cylinder having an axial bore extending completely through it, having an outwardly facing surface, and having a helical groove in said outwardly facing surface; and, wiper material seated in said helical groove and protruding radially outward beyond said outwardly facing surface of said hollow cylinder;

whereby, on an upstroke of the plunger, the wiper material precedes the plunger to wipe sand from the pump barrel, thereby reducing sand-caused wear on the plunger, and on a downstroke of the plunger the fluid being pumped flows past said upper wiper body, acting on said wiper material to impart a torque to said upper wiper body which causes the plunger to rotate so as to distribute wear on the plunger and pump barrel more evenly.

* * * * *